US007815067B2

(12) United States Patent
Matsumoto et al.

(10) Patent No.: US 7,815,067 B2
(45) Date of Patent: Oct. 19, 2010

(54) CONTAINER WITH SEALABLE LID

(75) Inventors: Tamotsu Matsumoto, Chiba-Ken (JP); Makiko Kida, Chiba-ken (JP); Eugene R. Kaneko, Astoria, NY (US)

(73) Assignee: Helen of Troy Limited, St. Michael (BB)

( * ) Notice: Subject to any disclaimer, the term of this patent is extended or adjusted under 35 U.S.C. 154(b) by 511 days.

(21) Appl. No.: 11/395,596

(22) Filed: Mar. 31, 2006

(65) Prior Publication Data

US 2007/0241107 A1 Oct. 18, 2007

(51) Int. Cl.
*B65D 39/12* (2006.01)
*B65D 53/00* (2006.01)

(52) U.S. Cl. ..... 220/234; 220/212; 220/803; 220/377; 215/359; 292/341.17; 292/DIG. 37

(58) Field of Classification Search ..... 220/238, 220/326, 377, 803, 212, 233, 234, 805; 292/DIG. 4, 292/DIG. 37, 341.17; 215/358, 359
See application file for complete search history.

(56) References Cited

U.S. PATENT DOCUMENTS 287,189 A * 10/1883 Stone ..... 220/238
3,750,822 A 8/1973 Dubach
3,977,563 A 8/1976 Holt
4,307,817 A 12/1981 Cotroneo
4,369,892 A 1/1983 Uhlig
4,844,263 A * 7/1989 Hadtke ..... 206/508
4,993,246 A * 2/1991 Kopper ..... 70/166
5,381,586 A 1/1995 Busscher et al.
5,584,408 A 12/1996 Orkisz
5,758,791 A 6/1998 Mangla
6,170,690 B1 * 1/2001 Hosoi ..... 220/238
6,193,093 B1 2/2001 Brunner
6,619,498 B2 9/2003 von Holdt, Jr.
6,845,877 B2 1/2005 Diesterbeck
6,869,114 B2 3/2005 Ueki
2005/0255737 A1 * 11/2005 Bella et al. ..... 439/352

* cited by examiner

*Primary Examiner*—Anthony Stashick
*Assistant Examiner*—James N Smalley
(74) *Attorney, Agent, or Firm*—Seyfarth Shaw LLP

(57) ABSTRACT

A storage container including a housing having an open-top wall structure defining a receptacle for receiving material to be stored. The container includes a cover disposable on the housing in a closed position relative to the receptacle. A button is movably carried by the cover and a seal. The seal is carried by the cover and shiftable between a compressed condition for sealingly engaging the wall structure when the cover is disposed in the closed position, and an uncompressed condition for disengaging from the wall structure. The container also includes a toggle mechanism coupled to the button and to the seal for effecting movement of the seal to its compressed and uncompressed conditions respectively in response to alternate actuations of the button.

17 Claims, 18 Drawing Sheets

CONTAINER WITH SEALABLE LID

BACKGROUND

Containers come in all shapes and sizes and store all different types of products. Certain containers, such as food containers, utilize a sealable cover or lid which forms a seal with the container to maintain quality and freshness of the food items stored in the container. There are several different types of covers or lids for these containers. Some containers use a snap-fit or friction-fit lid to form a seal with the container. These lids, however, are difficult to stretch and secure to the containers and are also difficult to remove because of the tight friction fit.

Other lids or covers include one or more latches which engage the container to hold the lid on the container. If the latches break or stop working properly, however, a new cover and possibly a new container must be purchased, which costs consumers additional time and money.

Accordingly, there is a need for improved containers having sealable lids which are easy to secure to and remove from a container and also provide a sufficient seal between the lid and the container to maintain a high level of freshness of the snacks and other items stored in the container.

SUMMARY

The present invention is directed to containers and more specifically, to containers having sealable covers.

One embodiment of the present invention provides a food storage container including a housing having an open top wall structure defining a receptacle for receiving food material to be stored. A cover is disposable on the housing in a closed position relative to the receptacle. The storage container includes a button removable carried by the cover in a sealed carried by the cover and shiftable between a compressed condition for sealingly engaging the wall structure when the cover is disposed in the closed position and an uncompressed condition for disengaging from the wall structure. The food storage container also includes a toggle mechanism coupled to the button and to the seal for effecting movement of the seal to its compressed and uncompressed condition respectively in response to alternate actuations of the button.

In an embodiment, the toggle mechanism includes a latch having two sides, where the sides respectively define heart-shaped cam surfaces, and where each of the cam surfaces include a first cam surface portion and a second cam surface portion.

In an embodiment, the heart-shaped cam surfaces are symmetrical.

In an embodiment, the toggle mechanism includes a pin pivotably connected to the button and engageable with the latch. The first cam surface portion is adapted to guide the pin to a locked position in response to a first actuation of the button, and the second cam surface portion is adapted to guide the pin to an unlocked position in response to a second actuation of the button.

In an embodiment, the toggle mechanism includes a latch, an open-top housing and a slider movably connected to the housing. The latch defines a first cam surface and a second cam surface. The toggle mechanism is operable to movably engage the latch with the housing causing the first cam surface to guide the slider to a locked position upon a first actuation of the button, and causing the second cam surface to guide the slider to an unlocked position upon a second actuation of the button.

In an embodiment, the cover includes an upper member, a bottom member and a cam plate connected to the bottom member, where the cam plate is movably connected to the upper member.

In an embodiment, the button is movable between an up position and a down position.

In an embodiment, the toggle mechanism includes a bias structure for biasing the button to the up position.

In an embodiment, the bias structure includes a pair of arms positioned adjacent to the button, where the arms are operable to pivot and move the button to the up position.

In an embodiment, the bias structure includes a spring operable to bias the button to the up position.

In an embodiment, at least one of the housing and the cover are substantially transparent.

Another embodiment provides a food storage device including a container having an open-top wall structure defining a receptacle for receiving a material to be stored. The food storage device includes a cover disposable on the wall structure, where the cover includes a top member defining a cup having a bottom surface, and where the bottom surface defines a plurality of slots. The food storage device also includes a bottom member positioned adjacent to the top member, and a cam plate connected to the bottom member, where the cam plate includes at least two posts and a latch. The posts are extendable through the slots of the receptacle. The latch includes two sides, where the sides respectively define heart-shaped cam surfaces. The food storage device also includes a seal positioned between the upper member and the bottom member of the cover, and a button including a bottom surface. The button is slidably connected to the cover. The food storage device further includes a pair of pivot arms positioned adjacent to the bottom surface of the button, where each of the pivot arms are pivotably connected to one of the posts of the cam plate. The pivot arms are connected to the posts after the posts are inserted through the slots of the bottom surface of the receptacle to connect the cam plate and the bottom member to the upper member. A pin is connected to the bottom surface of the button. The pin includes two opposing spaced apart arms. The arms are respectively engageable with the heart-shaped cam surfaces of the latch. When the button is actuated a first time, the pivot arms move downwardly and the cam surfaces guide the arms of the pin to a locked position causing the seal to expand outwardly and engage the wall structure. When the button is actuated a second time, the cam surfaces guide the arms to an un-locked position, where the seal dis-engages the container and the pivot arms move upwardly against the bottom surface of the button to correspondingly move the button upwardly to a popped-up position.

In an embodiment, the latch defines a recess, where the pin is engaged with the recess in the locked position.

In an embodiment, the food storage device includes a spring positioned adjacent to the top member. The spring biases the button to the popped-up position.

In an embodiment, the spring is a coil spring.

In an embodiment, at least one of the container and the cover are substantially transparent.

It is therefore an advantage of the present invention to provide a storage container having a housing and a cover, which is easily connected to and removed from the housing.

Another advantage of the present invention is to provide a storage container which maximizes the freshness and quality of the materials stored in the container.

It is a further advantage of the present invention to provide a storage container including a housing and a cover where the cover is connected and sealed to the housing using one hand.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION

Figure 1A:
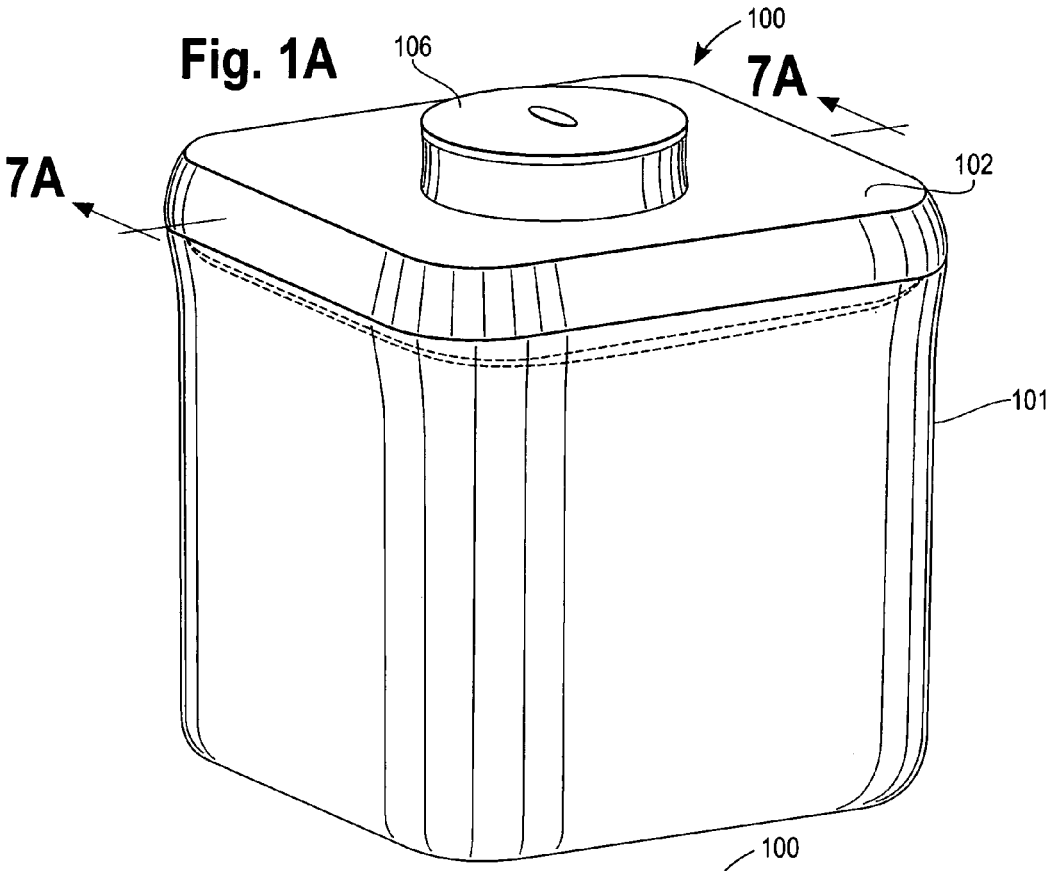
FIG. 1A is a perspective view of the container and lid of one embodiment of the present invention where the container and lid are not sealed together.

The present invention is directed generally to a container having a sealable cover or lid and more specifically, to a storage container for storing food or other items, where the container has a sealable lid that is sealed to the container using a push-push operation.

Referring now to FIGS. 1A to 8J, an embodiment of the storage container 100 is illustrated where the storage container includes a container 101 and the sealable cover or lid 102 where an item to be stored, such as food, is placed inside the container. The cover or lid 102 has a corresponding shape and size that is placed or disposed in an opening 104 defined by the top of the container 101. The lid 102 is loosely seated in the opening 104 of the container 101. To seal the lid 102 and container 101 together, a user pushes down on or presses an actuator or button 106 positioned in the middle of the cover or lid 102. Pushing down on the actuator or button 106 causes a seal member or seal 108 inside the lid 102 to expand and form a seal between the lid 102 and the container 101. The seal 108 between the lid 102 and the storage container 100 helps to preserve items, such as food items, stored in the container 101. To remove the item stored in the container 101, the user actuates the actuator or presses the button 106 to release the seal (i.e., causing the seal to return to its original non-compressed form) and thereby release the lid from the container. The user is now able to easily remove the cover or lid from the container to access the contents of the container.

The storage container 100 therefore allows a user to easily and quickly seal a container and alternatively to release the seal and remove contents from the storage container 100. The illustrated embodiment of the storage container shows the container 101 and lid 102 having a particular size and shape. It should be appreciated however, that the container 101 and lid 102 may have any suitable sizes and/or shapes to accommodate different storage items.

Figure 1B:
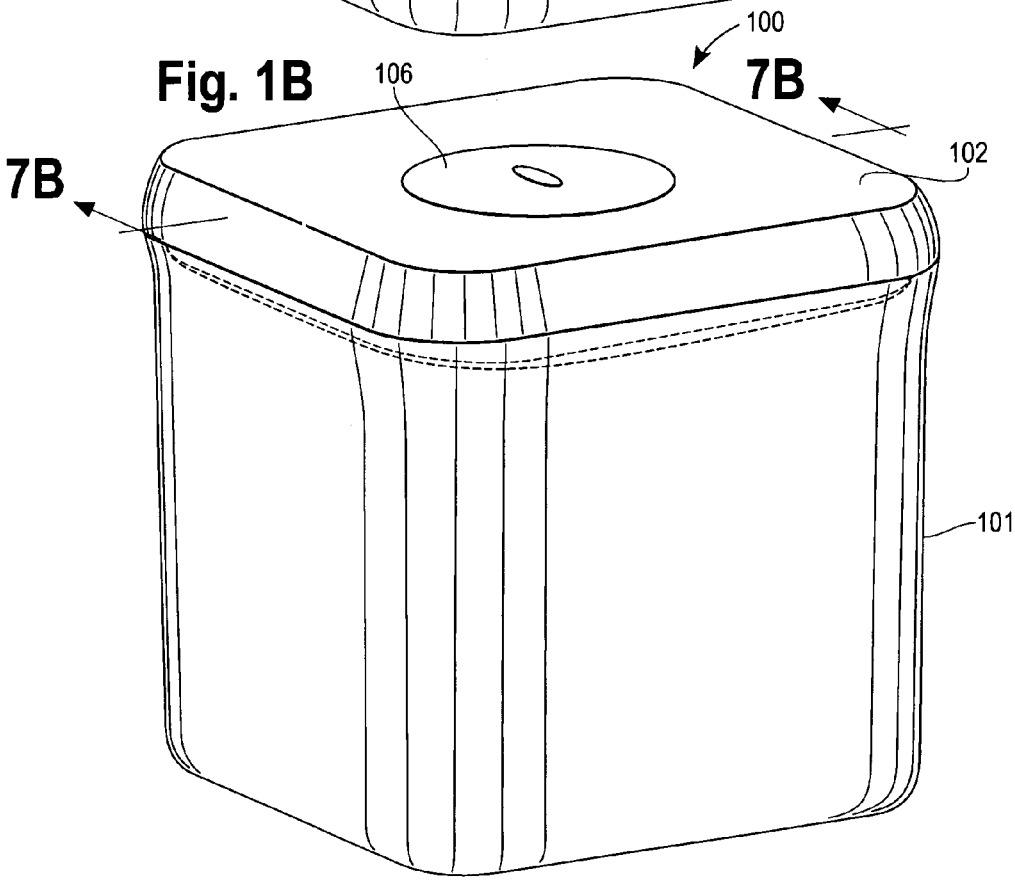
FIG. 1B is a perspective view of the container and lid of FIG. 1A where the container and the lid are sealed together.
Figure 1C:
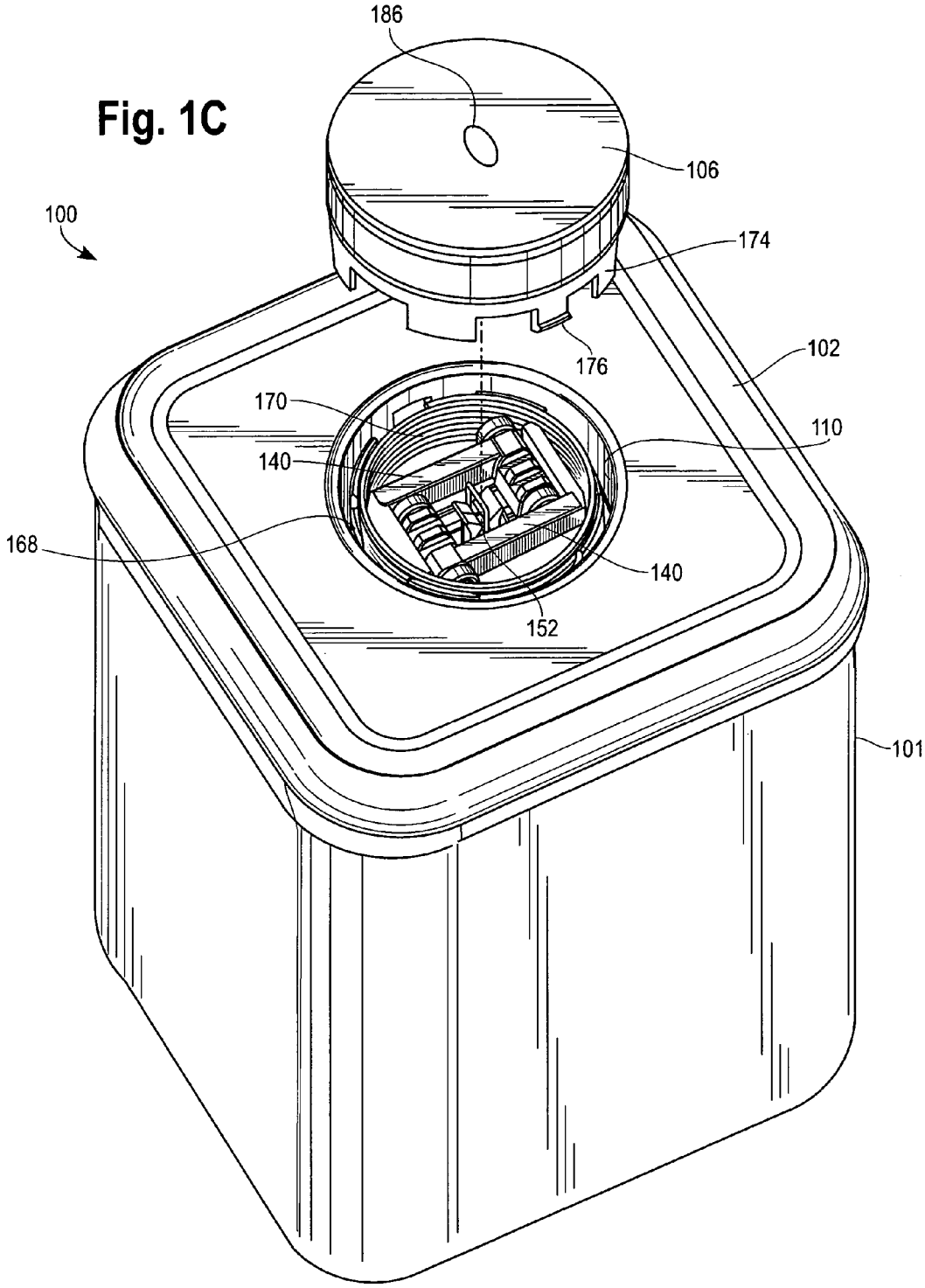
FIG. 1C is an exploded perspective view of the container and lid of FIGS. 1A and 1B illustrating the button removed from the lid.

Referring now to FIGS. 1A, 1B and 1C, the storage container 100 includes a container, housing, or body 101 and a lid 102 which is sealable to the housing. The housing 101 includes an open-top wall structure 110 and a bottom wall 112 which cooperate to define a receptacle 114 for receiving and storing one or more food items. The open-top wall structure 110 may include one integrally formed wall or a plurality of walls. Also, the container 101 and lid 102 may be any suitable size and shape and are generally made of a durable material such as a polymer or plastic which can be formed or extruded to any desired shapes and sizes. In an embodiment, the container or housing 101 is made of a clear, transparent or substantially transparent material such as a clear plastic to enable a user to view the contents stored in the container. It should be appreciated that the container may also be semi-transparent or opaque. Additionally, it should be appreciated that the container may have any suitable color or combination of colors.

In the illustrated embodiment, the cover or lid 102 includes a top lid assembly 116 connected to a bottom lid assembly 118. The seal member, gasket or seal 108 is positioned between the top and bottom lid assemblies 116, 118 and is shiftable between a compressed condition for engaging the wall structure when the lid 102 is in a closed position, and an uncompressed position for disengaging the lid 102 from the wall structure 110. The top and bottom lid assemblies 116, 118 therefore act as a toggle mechanism coupled to the button 106 and the seal to move the seal 108 between the compressed and uncompressed conditions based on alternate actuations of the button 106. The engagement of the seal 108 with the container 101 seals the container and lid together.

Figure 2:
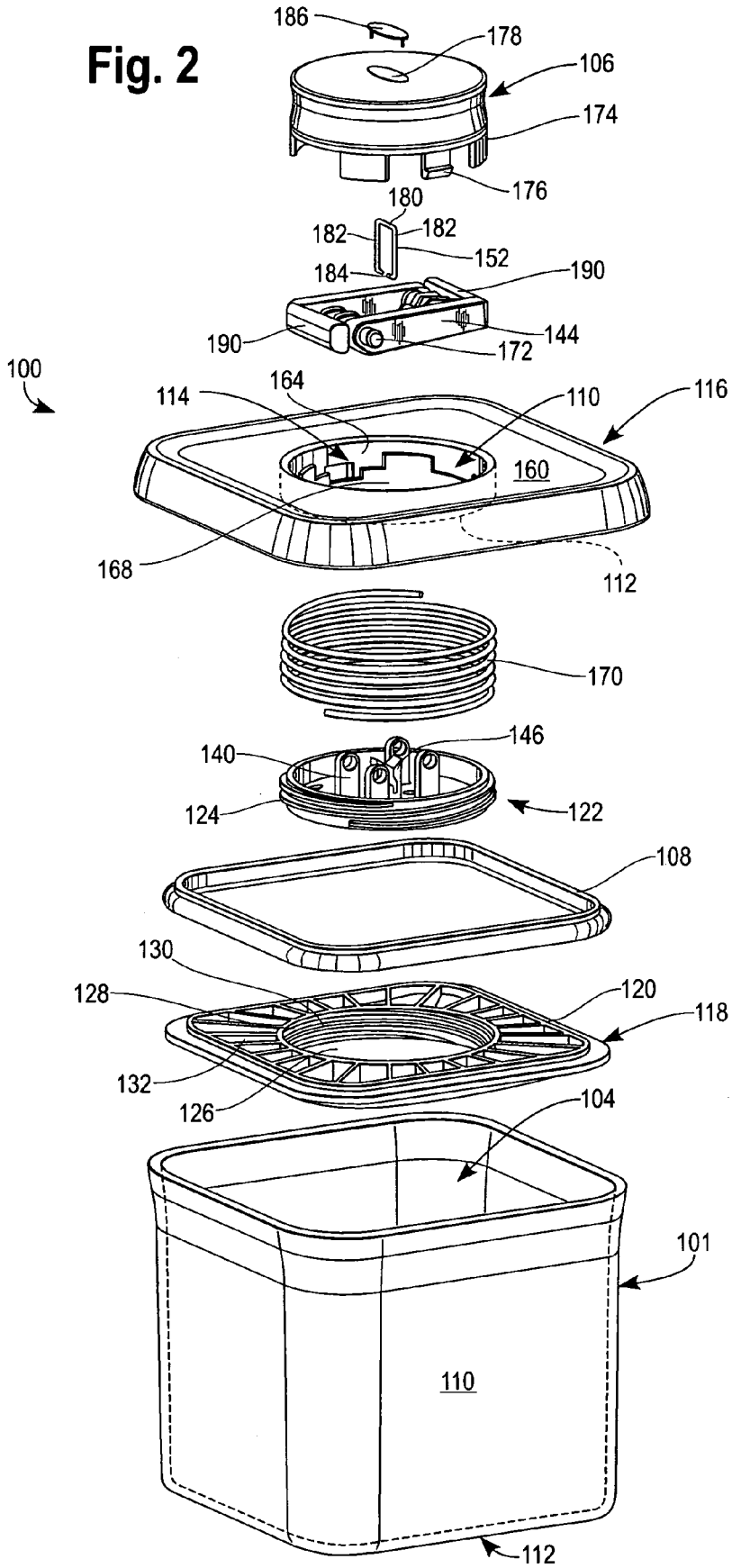
FIG. 2 is an exploded perspective view of the container and lid of FIGS. 1A and 1B.
Figure 3A:
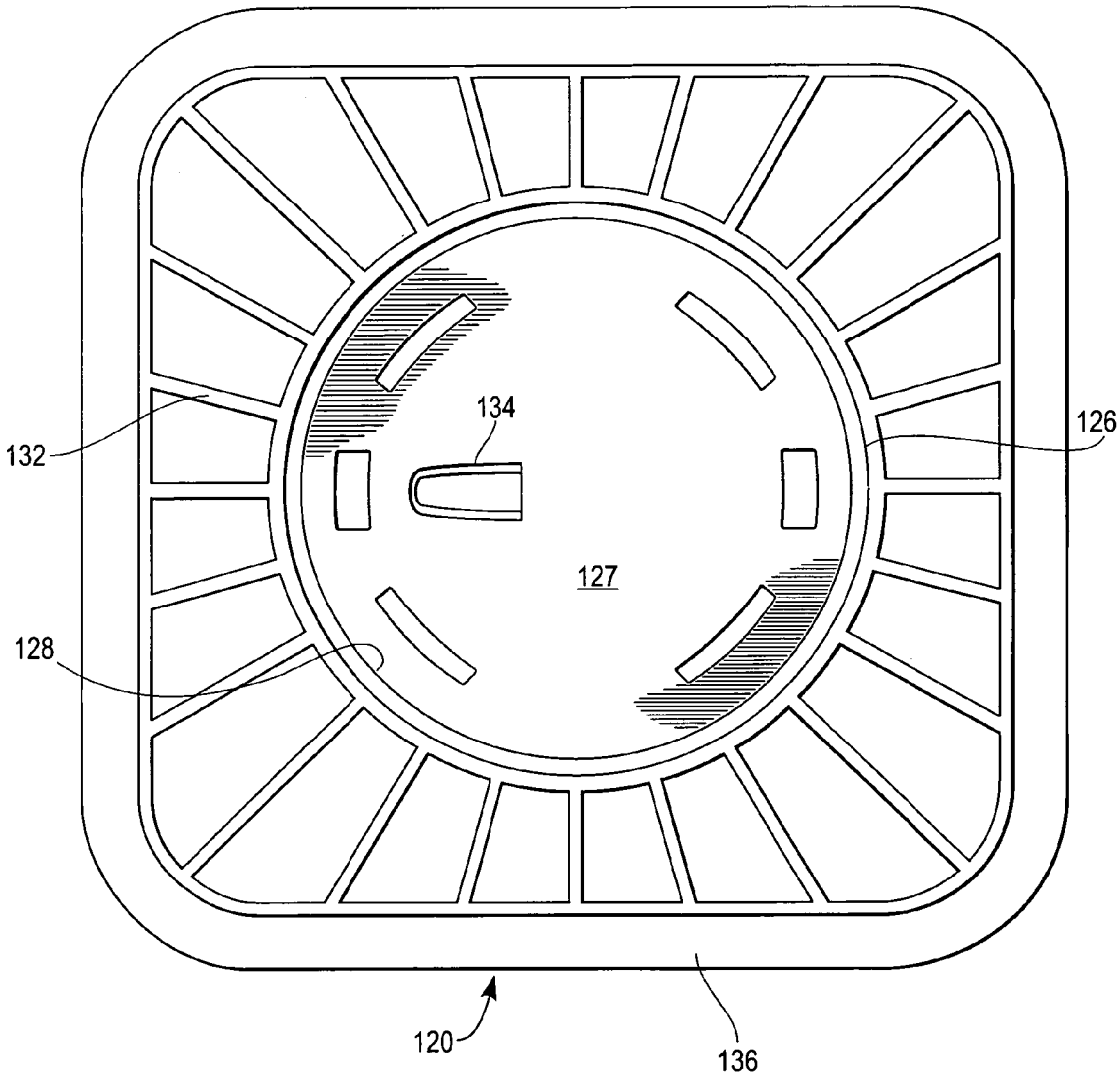
FIG. 3A is a top view of the bottom member of the lid of FIG. 2.
Figure 3B:
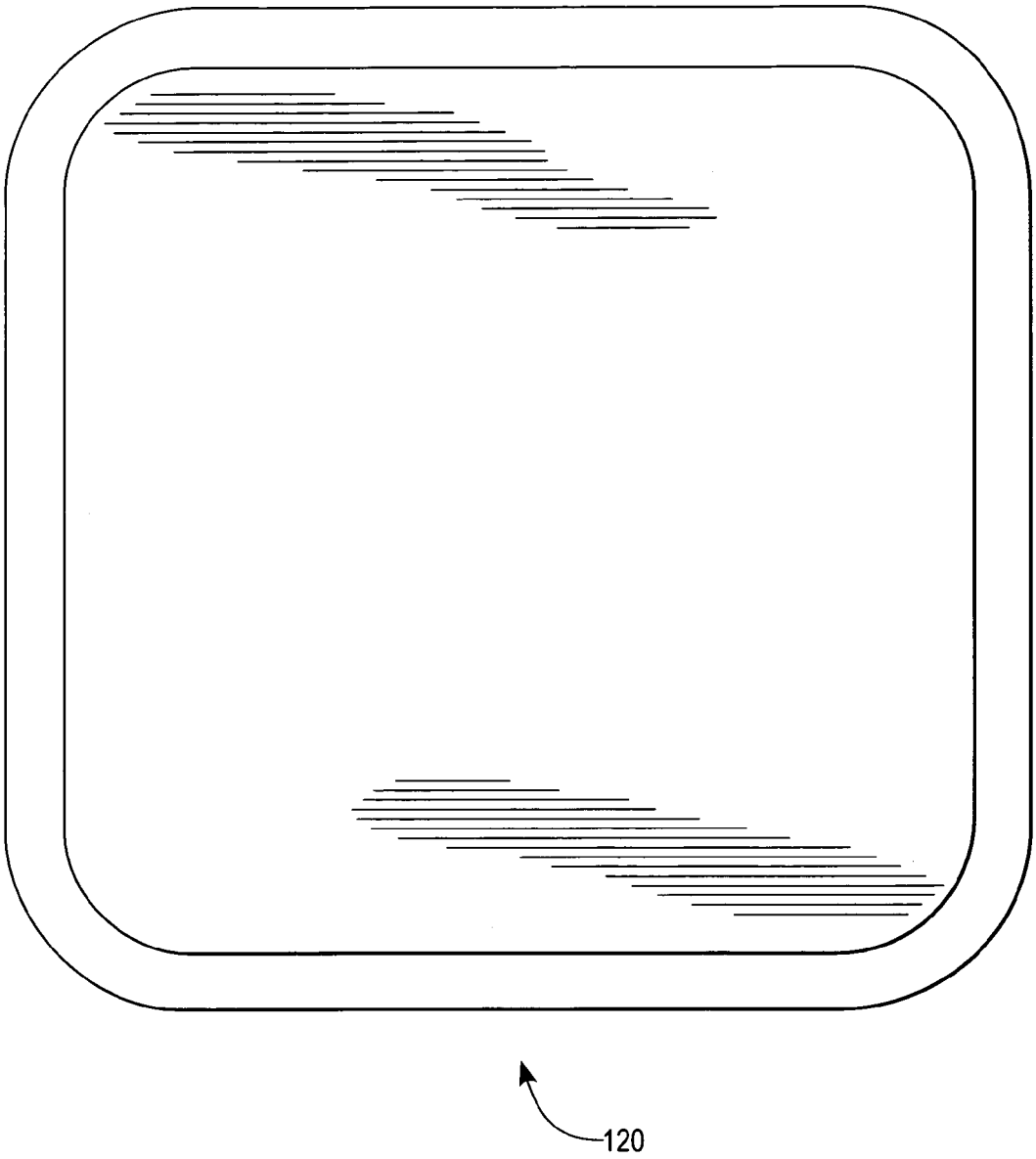
FIG. 3B is a bottom view of the bottom member of the lid of FIG. 2.

Referring to FIGS. 2, 3A, 3B, 4A, 4B, 4C and 4D, the bottom lid assembly 118 includes a bottom member 120 and a latch plate 122. The latch plate 122 defines a plurality of threads 124 which threadingly engage the bottom member 120 to secure the latch plate 122 to the bottom member. The bottom member 120 has a generally rectangular shape and is molded or formed to correspond to the size and shape of the opening 104 defined by the housing. As shown in FIGS. 2 and 3A, the bottom member 120 defines a circular receptacle 126 having a bottom surface 127. An inside surface 128 of the receptacle 126 includes at least one and preferably a plurality of thread members or threads 130. A plurality of flange members 132 extend from the receptacle 126 to the perimeter of the bottom member 120 to provide structural support and integrity. The bottom surface 127 of the receptacle defines a detent 134 which is used to secure the latch plate 122 to the bottom member 120 as described in detail below. The bottom member 120 is generally planar, tapers upwardly at the edges and has rounded corners as best shown in FIG. 2. The bottom member 120 also defines a top channel 136 which is adapted to receive the seal 108.

Cam plate or latch plate 122 is a generally circular plate. The latch plate 122 is secured to the receptacle 126 by turning, twisting or screwing the latch plate into the receptacle. In the illustrated embodiment, the latch plate 122 is turned or twisted in a clockwise direction to secure it to the bottom member 120. The latch plate 122 is turned or twisted within the receptacle 126 until resilient U-shaped tab 138 engages detent 134 on the bottom surface 127 of the receptacle 126. The U-shaped tab 138 is dis-engaged from the detent 134 by forcibly rotating or twisting the latch 122 plate in a counter clockwise direction. The engagement of the tab 138 with the detent 134 helps to secure the latch plate 122 to the bottom member 120 and prevent the latch plate 122 from twisting or turning out of position after assembly and during use.

Figure 4A:
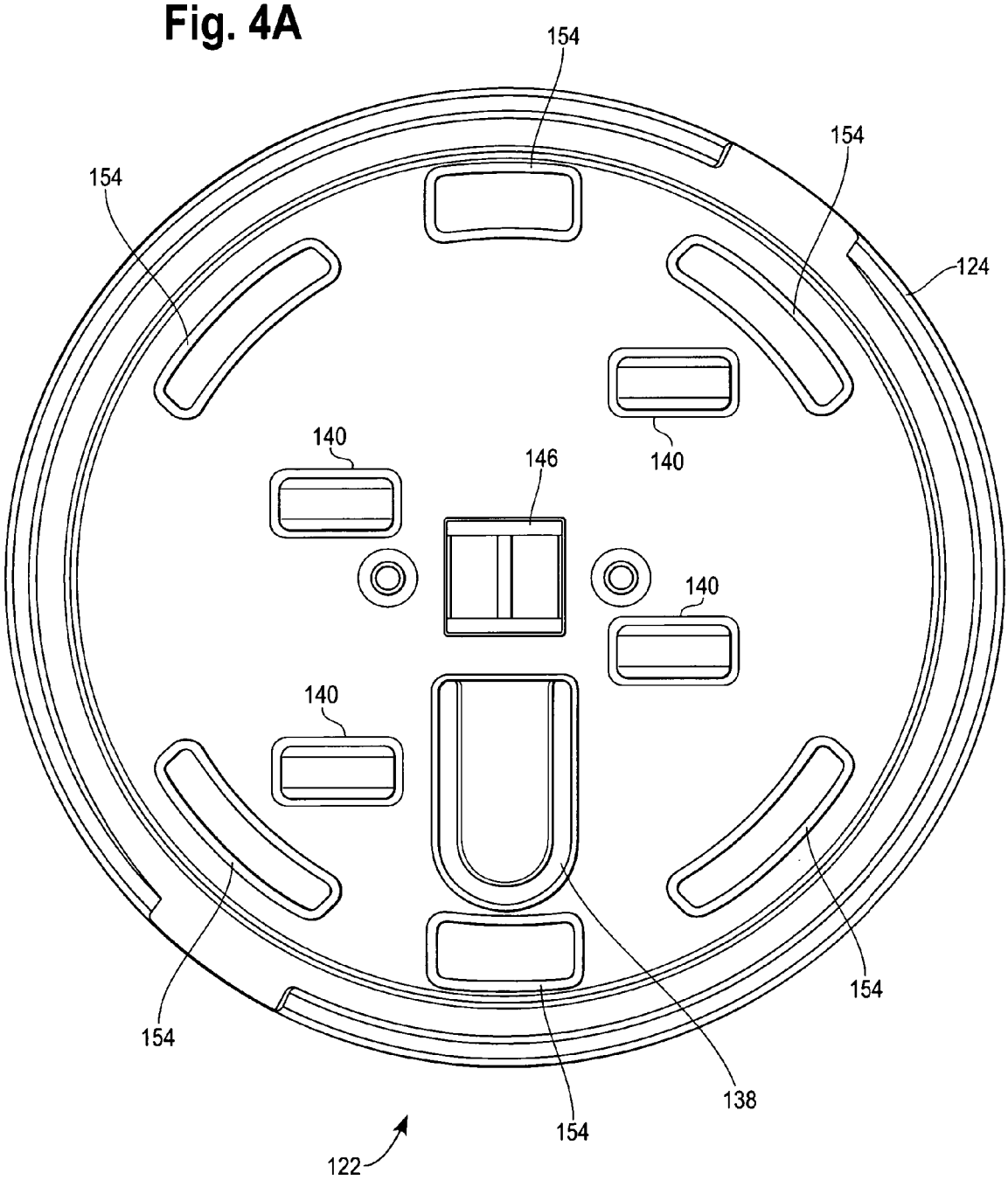
FIG. 4A is a top view of the latch plate of the lid of FIG. 2
Figure 4B:
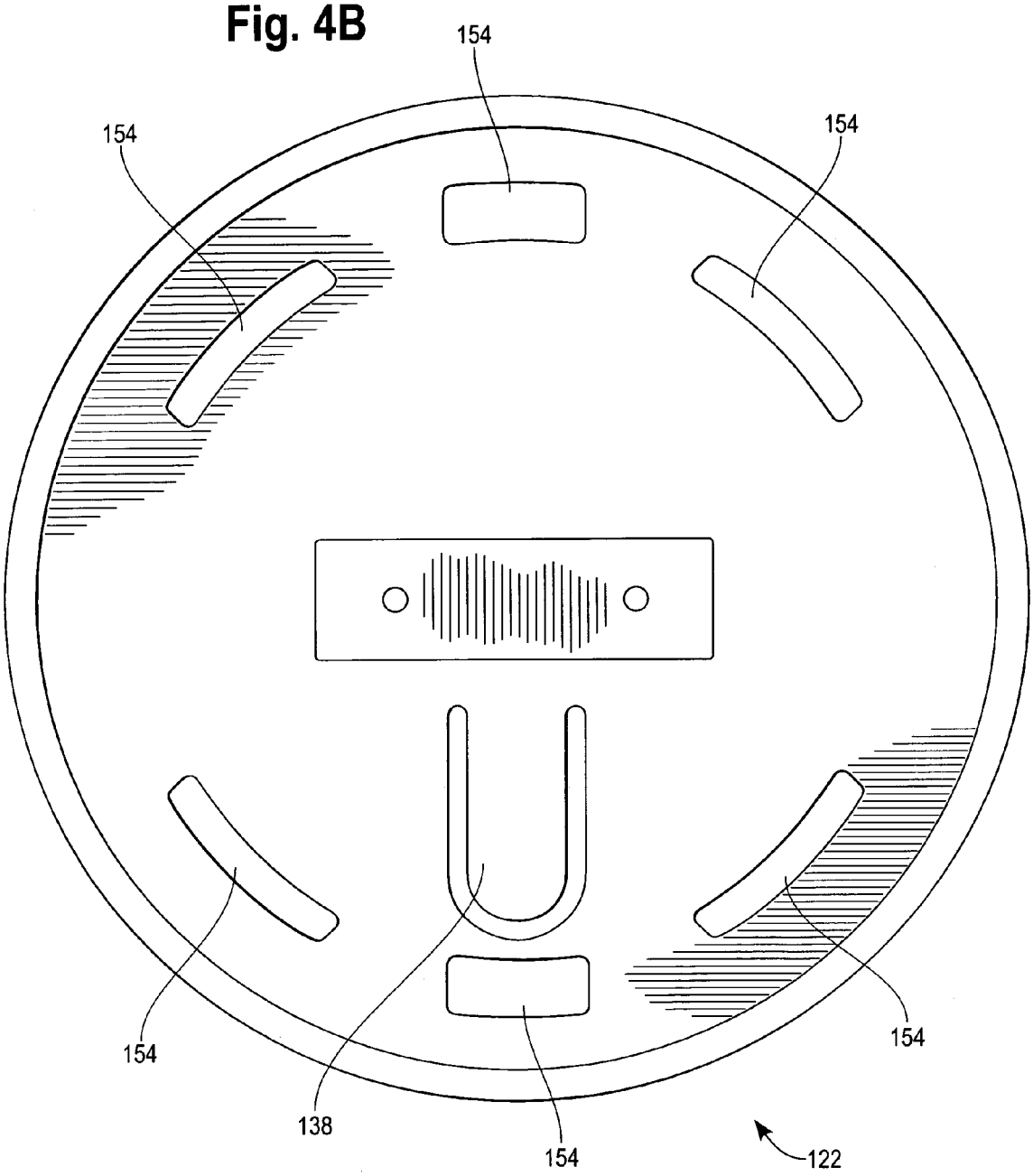
FIG. 4B is a bottom view of the latch plate of the lid of FIG. 2.
Figure 4C:
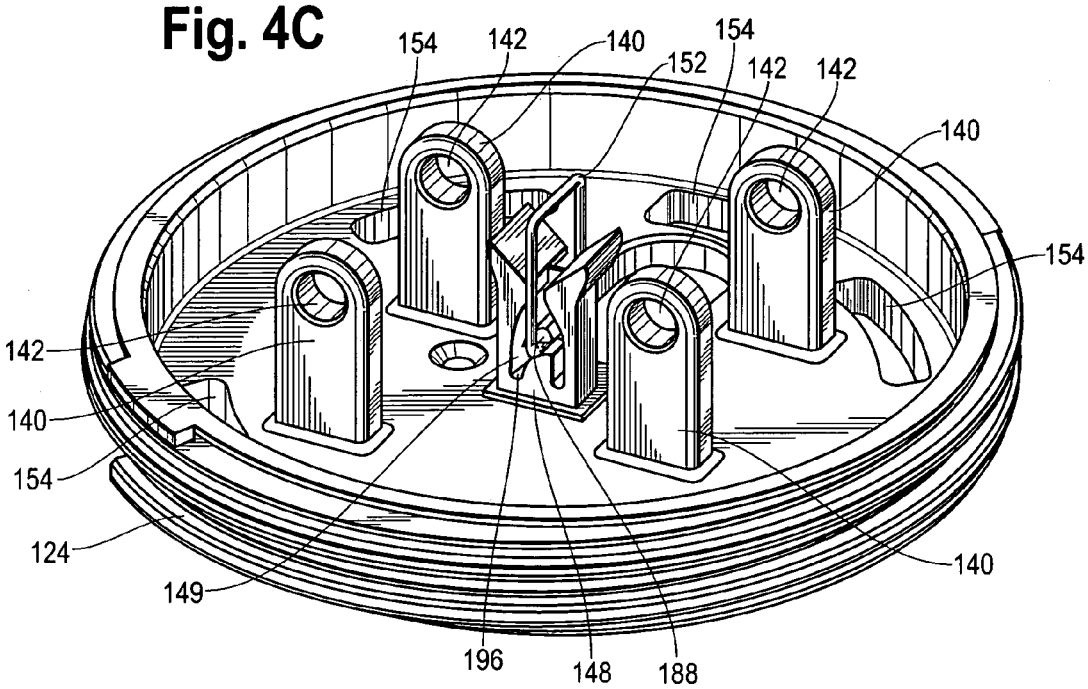
FIG. 4C is a top perspective view of the latch plate of the lid of FIG. 2.

The latch plate 122 includes a plurality of pivot members 140 which are generally upright, vertical members. The pivot members 140 are positioned in pairs and are connected to the latch plate 122. In one embodiment, the pivot members 140 are integrally formed with the latch plate 122. In another embodiment, the pivot members 140 are separate parts which are connected to the latch plate 122. A designated or predetermined distance separates each pair of the pivot members 140. As illustrated in FIG. 4C, each of the pivot members defines an opening 142. The opening on each pivot member extends from one side to the other side of the pivot member. Alternatively, a depression, detent or receptacle may be formed in the pivot members instead of an opening. Each pivot member 140 extends vertically above the outer wall of the latch plate. As described below, each opposing pair of the pivot members 140 receives an arm 144 and enable the arms to move, rotate or pivot with respect to the pivot members.

The latch plate 122 also includes a latch 146. The latch 146 is a generally rectangular member which extends vertically above the bottom surface 127 of the latch plate. The latch 146 includes a pair of opposing sides 148 and defines a central opening 150 therebetween. The sides 148 may be the same or different sizes or shapes. In the illustrated embodiment, the opposing sides 148 of the latch 146 define non-symmetrical heart-shaped cam surfaces or cam surface portions 149 which guide pin 152. In another embodiment, the cam surface portions 149 are symmetrical. It should be appreciated that the cam surfaces 149 may be of any suitable size, shape or configuration. The latch plate 122 further defines a plurality of tab openings 154 which receive tabs 174 extending downwardly from button 106.

Referring now to FIGS. 1C, 2, 5A and 5B, the top lid assembly 116 includes a top member 158 having a top surface 160 and a bottom surface 162. The top member 158 has a generally rectangular shape and includes a wall 164 which begins at the top surface 160 and tapers outwardly toward the bottom surface 162. The wall 164 therefore defines a receptacle or cup 166 having a generally circular shape. The cup 166 includes an inner wall 168 adapted to guide an stabilize the button 106. A coil spring 170 is positioned below the cup 166 of the top member 158 as shown in FIG. 2. The seal 108 is positioned between the top lid assembly 116 and the bottom lid assembly 118. In one embodiment, the seal 108 is connected to the top member 158 using one or more tabs or protrusions (not shown) which receive the seal 108 to hold it in place.

Referring now to FIG. 2, in one embodiment, the seal 108 has a generally v-shaped cross section. It should be appreciated that the seal 108 may have any suitable shape, cross-section or configuration. In the illustrated embodiment, the seal 108 is made of a substantially deformable material such as a suitable rubber which can expand and contract to form the seal between the container 101 and the lid 102 as described above. When the seal 108 is connected to the bottom surface 162 of the top member 158, the bottom lid assembly 118 and more specifically, the pivot members 140 and latch 146 are inserted through corresponding openings defined in the bottom surface 162 of the cup 166. The pivot members 140 and latch 146 extend through the openings and upwardly within the cup 166 to a designated distance or height within the cup. Pivot arms or arms 144 are attached between each pair of pivot members 140 to hold or secure the bottom lid assembly 118 to the top lid assembly 116.

Referring to FIGS. 1C, 6A, 6B, 6C and 6D, in one embodiment, each of the arms 144 such as arm 144*a* includes opposing outwardly extending stubs or posts 172 which correspond in size and shape to rotatably engage the openings 142 of opposing pairs of the pivot members 140 as shown in FIG. 1C. Specifically, each of the arms 144 are positioned between a pair of the pivot members 140 and the posts 172 engage the openings 142 defined by the pivot members 140. The arms 144 therefore snap in or click in place and freely pivot or rotate about an axis extending horizontally through the centers of the openings 142 on each pair of pivot members 140.

The cap, actuator or button 106 is connected to the top lid assembly 116. The button 106 is generally circular in shape and has a plurality of downwardly extending tabs 174. The button 106 is sized to correspond to the size of the receptacle 114 and move or slide downwardly into cup 166 in the top lid assembly 116. The tabs 174 extend downwardly and are received by corresponding openings 167 defined in the bottom surface of the cup 166. One or more of the downwardly extending tabs 174 include a flange 176 which fits through the openings 167 defined by the bottom surface of the cup 166. The flanges 176 extend outwardly from the tabs 174 to inhibit the tabs and thereby inhibit the button 106 from moving upwardly through the openings and being removed from the top member 158. The downwardly extending tabs 174 are sized to allow the button 106 to move upwardly and downwardly between an engaged and disengaged or popped-up position as illustrated in FIGS. 1A and 1B.

In another embodiment, an arm 144 such as arm 144*b* includes a first arm member 191 and a second arm member 193, which is connected to the first arm member as described above. Opposing sides 197*a* and 197*b* are secured together by support member 195. Also, the sides 197*a* or 197*b* cooperate to secure and support a roller 205. The roller 205 rotates about an axis transverse to the sides 197*a* and 197*b*. Pins 203 are integrally formed with the roller 205 to help secure the roller in openings defined by sides 197*a* and 197*b*. Posts 201 extend generally outwardly from sides 197*a* and 197*b* to rotatably connect arm 149 to pivot members 140. It should be appreciated that pins 201 and 203 may be separate parts which are connected to sides 197*a* and 197*b*, and roller 205, respectively. In this embodiment, the roller 205 helps to minimize friction generated by the arm when the arm pivots upwardly and downwardly with respect to the underlying support surface.

The U-shaped pin member or pin 152 described above is inserted through an opening 178 defined in the top surface of the button 106. The U-shaped pin 152 includes a lateral member 180 and two side members 182 extending downwardly therefrom. Each end of the side members 182 include opposing prongs 184 which extend toward each other and are generally in the same plane. The U-shaped pin 152 is inserted through the opening 178 defined by the button and snaps into a channel (not shown) defined by the bottom surface of the button 106. The channel is sized to enable the lateral member 180 of the U-shaped pin 152 to engage the channel in a snap-fit or friction fit connection. The engagement of the lateral member 180 and the channel secure the U-shaped pin 152 to the bottom surface of the button 106 and allows the pin to at least partially move or pivot with respect to the button.

A cap or cover 186 is snapped into the opening 178 defined by the button to close the opening. In one embodiment, the cover 186 includes a decorative design such as a company logo. It should be appreciated that the cover may include any suitable design, words, pictures or images.

The coil spring 170 is positioned below the top member 158, and more specifically below, the cup 166 to help to bias actuator or button 106 upwardly away from the lid 102. Alternatively, the coil spring 170 may be positioned in the receptacle 114 inside of the inner wall 168. It should be appreciated that the coil spring 170 may be any suitable spring which has any suitable size or shape.

The following paragraphs describe the push-push operation of the lid and the engagement of the lid 102 with the container 101. Initially, the lid 102 is removed from the container 101 and an item, such as a food item, is placed inside the container. As described above, the lid 102 is seated in the open-top wall structure 110 of the container 101. A user actuates the actuator or presses down on the button 106 to cause a seal to be formed between the lid 102 and the container 101.

Referring to FIGS. 1A, 1B, 1C, 2, 7A, 7B, 7C, 7D and 7E, as the actuator or button 106 is pressed downwardly, the U-shaped pin 152 and more specifically, the prongs 184 move downwardly into the opening 150 of the latch 146. Depending on the positioning of the prongs 184, the angled surfaces defining the opening 150 at the top of the latch 146 guide the prongs 184 into the opening 150 to account for any lateral displacement of the pin 152. When the button 106 is pressed downwardly such that the prongs 184 enter the opening 150, the prongs each simultaneously engage the cam surfaces 149 defined by the opposing sides 148 of the latch 146. Each prong 184 moves downwardly along first cam surface 149*a* until the prongs engage recess 188. When the prongs 184 each engage the recess 188, the pin 152 is secured in place and neither the pin 152 nor the button 106 can move upwardly out of the receptacle 114 of the top member 158.

While the button 106 is pressed downwardly within the receptacle 114, lateral portions 190 of the arms 144, which are positioned adjacent to and engage the bottom surface of the button 106, are also pushed downwardly. Each of the arms 144 include the lateral portions or members 190 and an opposing angled surface 192 which contacts the bottom surface of the cup 166. As the arms 144 are pushed downwardly, the point or tip 194 of the angled surface 192 engages the bottom surface of the cup 166 thereby pushing the cup or top member 158 downwardly. At the same time, the angled surface 192 of the arms 144 act as a lever causing the arms to pull the pivot members 140 upwardly within the cup 166. This correspondingly causes the bottom member 120 to move upwardly toward the top member 158. The movement of the bottom member 120 towards the top member 158 compresses the seal 108 between the top and bottom members. As the seal 108 is compressed or moved to a compressed position, it expands outwardly and engages or pushes against the wall structure 110 of the container 101. The pressure of the outwardly extending seal 108 with the wall structure 110 enables the container to hold or secure the lid 102 to the container 101. As stated above, the U-shaped pin 152 is positioned in the recess 188 and is therefore in the locked position. The engagement of the seal 108 with the container 101 also forms a tight seal between the lid 102 and the container 101 to maximize freshness and preserve the item or items stored in the container.

Figure 4D:
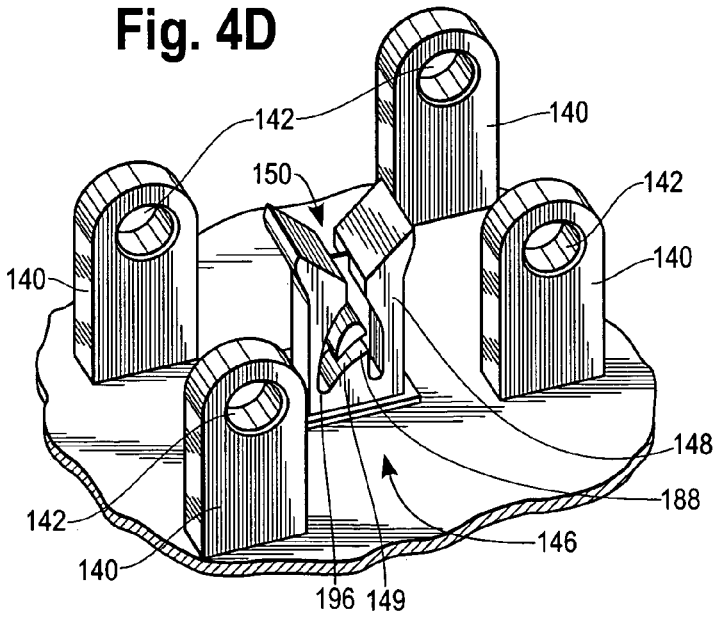
FIG. 4D is a fragmentary perspective view of the latch plate of the lid of FIG. 2 illustrating one side of the latch plate.
Figure 5A:
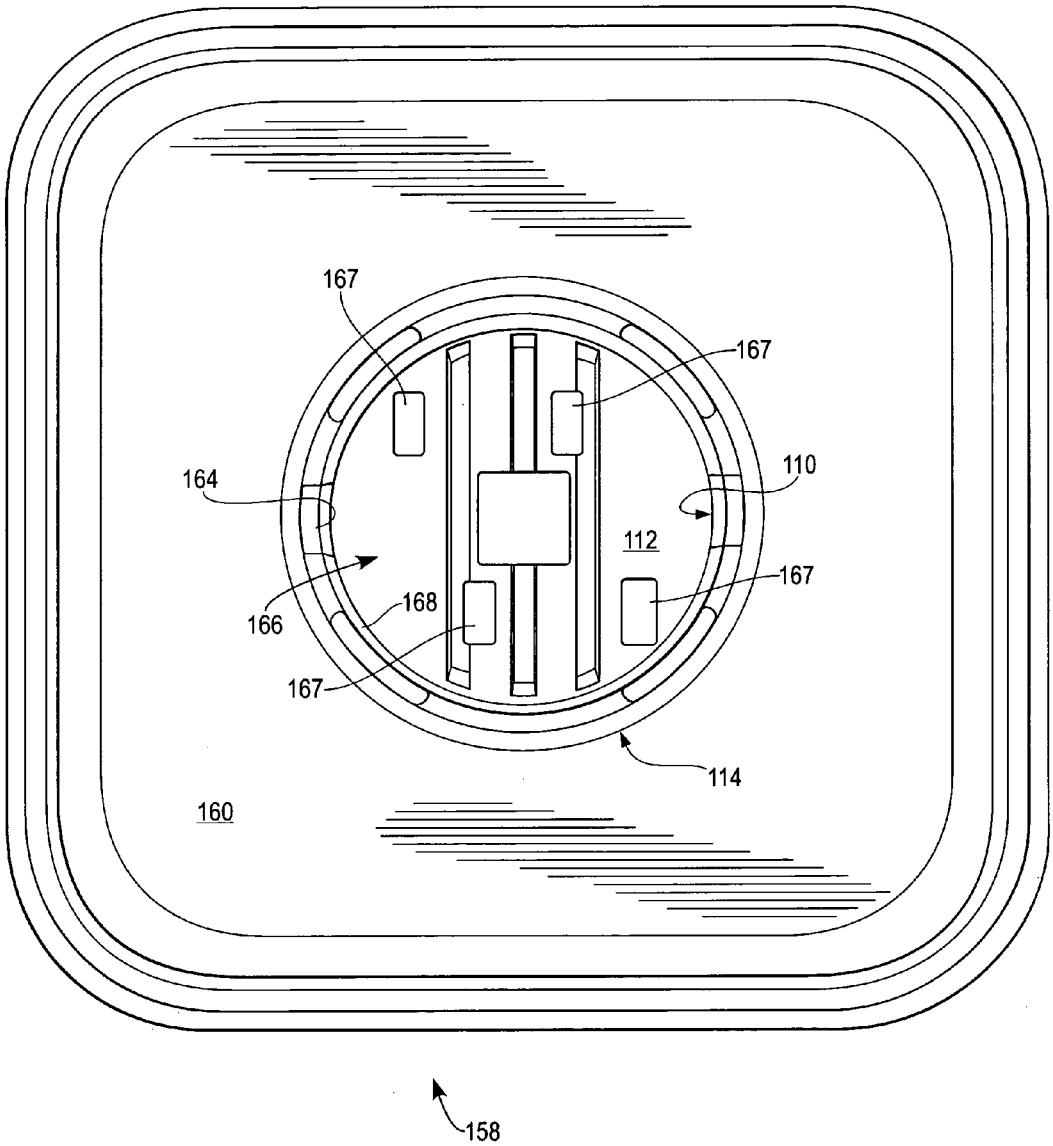
FIG. 5A is a top view of the top member of the lid of FIG. 2.
Figure 5B:
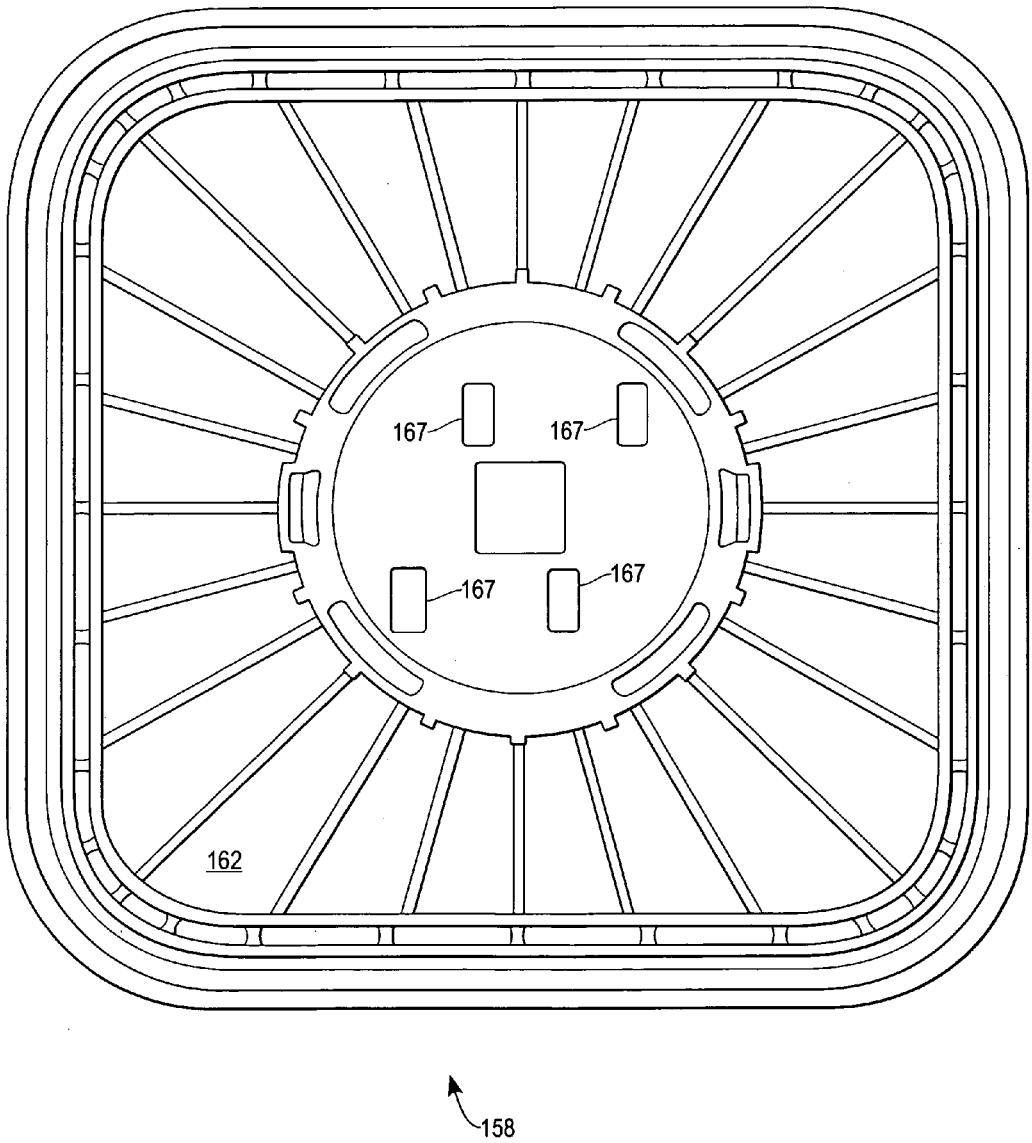
FIG. 5B is a bottom view of the top member of the lid of FIG. 2.
Figure 6A:
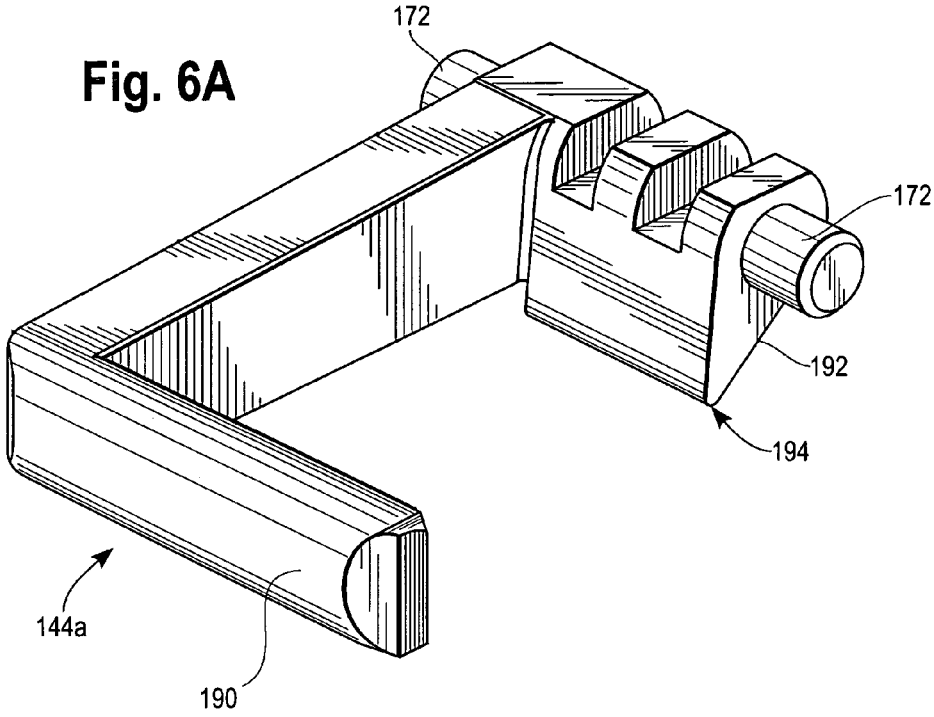
FIG. 6A is a perspective view of one embodiment of an arm illustrated in FIG. 2.
Figure 6B:
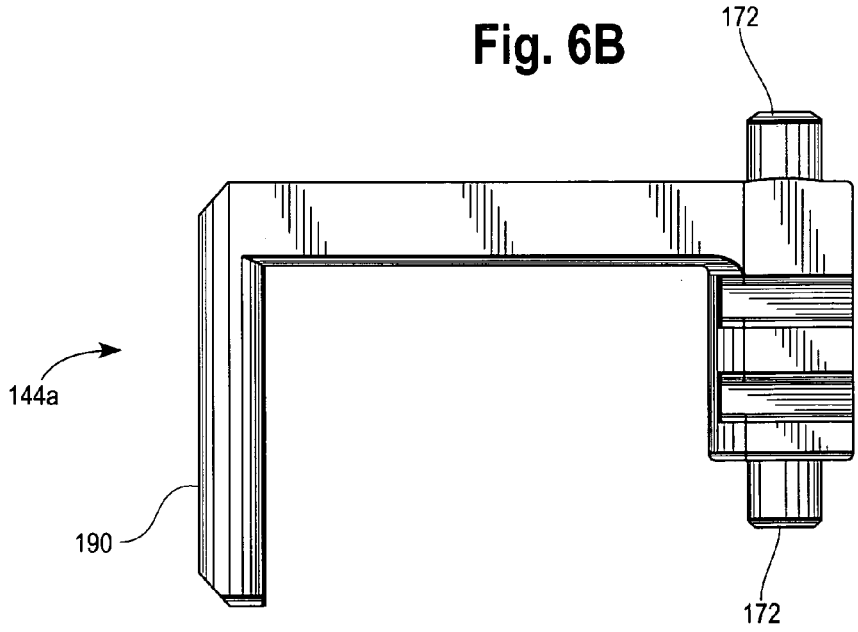
FIG. 6B is a top view of the arm of FIG. 6A.
Figure 6C:
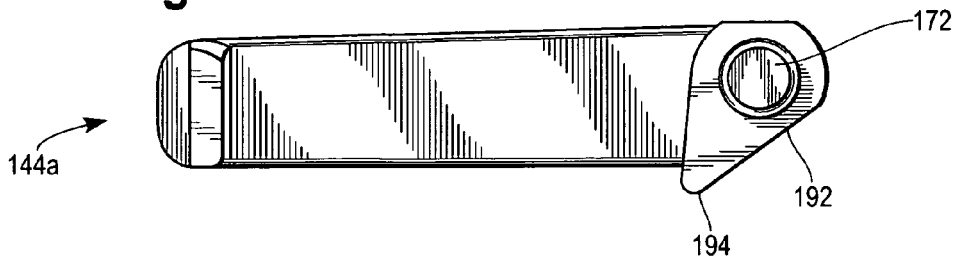
FIG. 6C is a right side view of the arm of FIG. 6A.
Figure 6D:
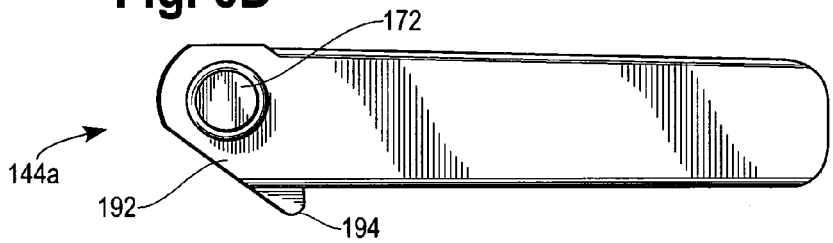
FIG. 6D is a left side view of the arm of FIG. 6A.
Figure 6E:
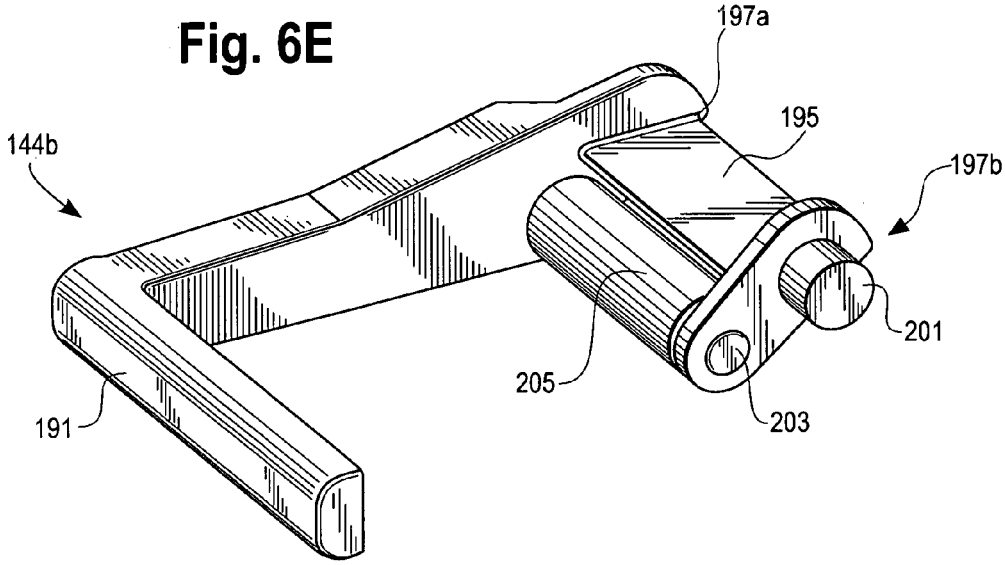
FIG. 6E is a perspective view of another embodiment of the arm illustrated in FIG. 2.
Figure 7A:
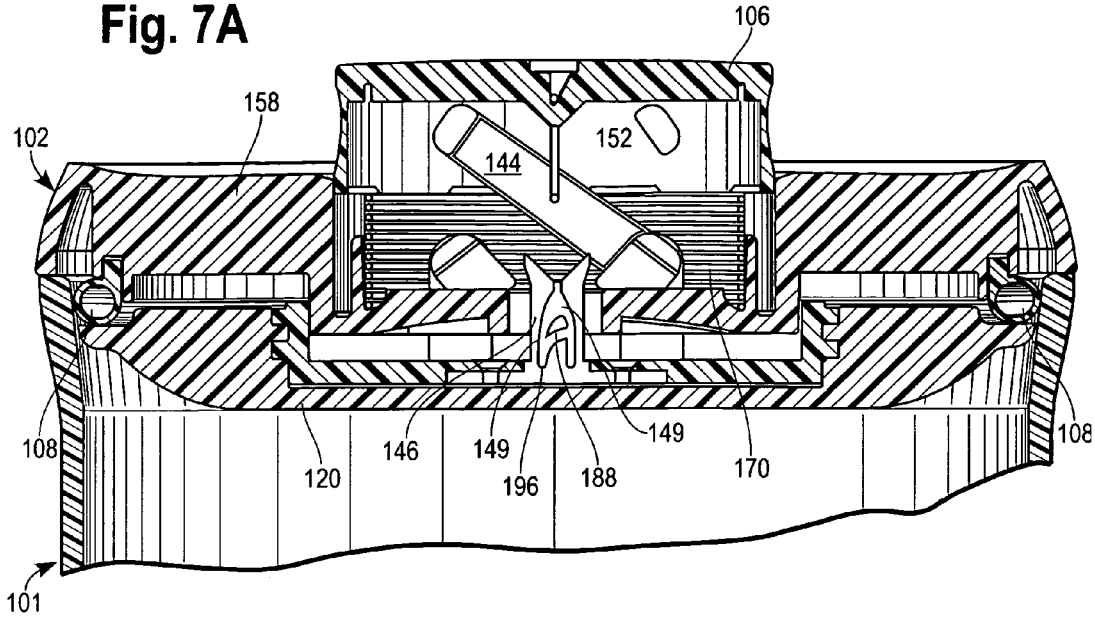
FIG. 7A is a cross-section view of the lid taken substantially along line 7A-7A illustrated in FIG. 1A.
Figure 7B:
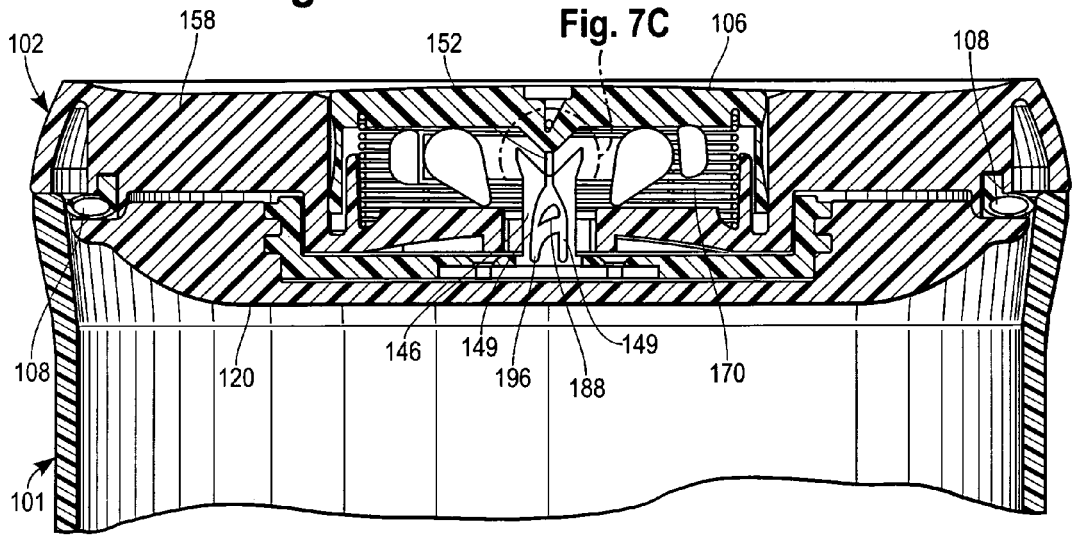
FIG. 7B is a cross-section view of the lid taken substantially along line 7B-7B illustrated in FIG. 1B.
Figure 7C:
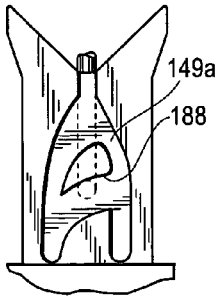
FIG. 7C is an enlarged fragmentary elevation view of a first side of the latch of FIGS. 7A and 7B illustrating the pin engaged with the latch.
Figure 7D:
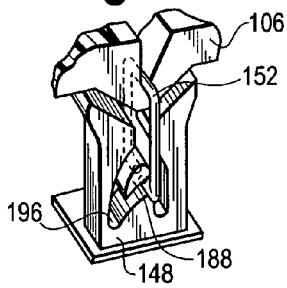
FIG. 7D is an enlarged fragmentary perspective view of the latch of FIG. 7C illustrating the pin engaged with the latch.
Figure 7E:
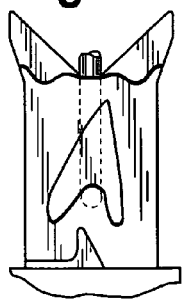
FIG. 7E is an enlarged fragmentary perspective view of a second side of the latch of FIGS. 7A and 7B illustrating the pin engaged with the latch.

To release and remove the lid 102 from the container 101, a user activates the actuator or presses the button 106. Pressing the button 106 downwardly correspondingly moves the prongs 184 of the U-shaped pin 152 downwardly along cam surfaces 149 of the latch 146. As shown in FIGS. 4C, 4D and 4E, the shape of cam surfaces 149 forces the prongs 184 to move laterally downwardly into the corner 196 defined by the cam surfaces. The distances between the recess 188 and the corner 198 is approximately the same distance that the top member 158 moves toward the bottom member 120 to further compress the seal 108 between the top and bottom members. The user releases the downward pressure on the button 106. The seal 108 which was compressed, now returns to its original shape and pushes upwardly on the top member 158 and downwardly on the bottom member 120 to cause the top and bottom members to move apart.

As the top member 158 moves upwardly, the pivot members 140 are moving downwardly through slots or openings 167 defined in the bottom surface of the receptacle or cup 166. The angled surfaces 192 of each of the arms 144 contact the bottom surface 162 of the cup 166 as the arms 144 are pulled or moved downwardly with the pivot members 140. Engagement of the angled surfaces 192 of the arms 144 with the bottom surface 162 of the cup 166 causes the arms to pivot upwardly. The upward movement of the arms 144, which are positioned adjacent to and engage the bottom surface of the button 106, correspondingly move the button 106 upwardly until the seal 108 returns to its original shape. The button 106 is now in the popped-up position with respect to the lid 102 as shown in FIG. 1A. The user may now remove the lid 102 from the container 101.

Figure 8A:
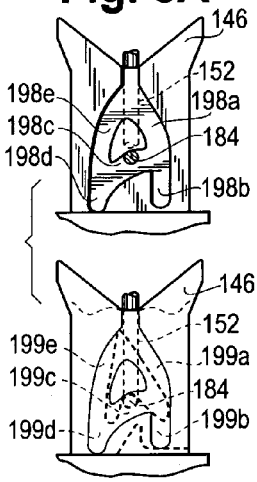
FIGS. 8A, 8B, 8C, 8D, 8E, 8F, 8G, 8H, 8I and 8J are enlarged elevation views of the first and second sides of the latch of FIGS. 7A and 7B illustrating an example of the movement of the pin along the cam surfaces defined by the first and second sides of the latch.
Figure 8B:
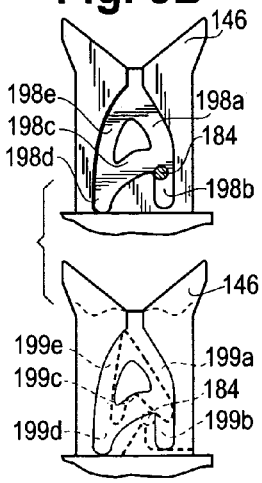
Figure 8C:
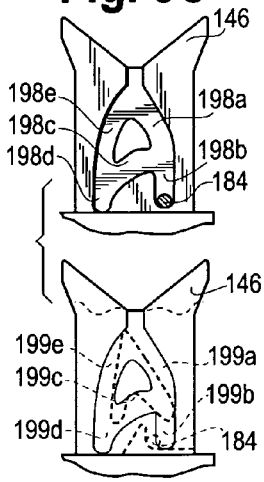
Figure 8D:
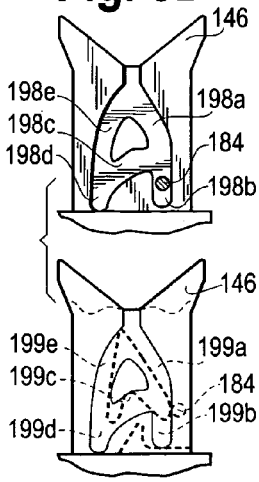
Figure 8E:
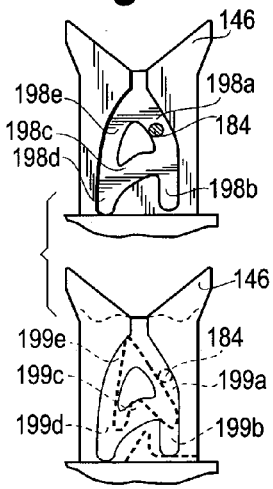
Figure 8F:
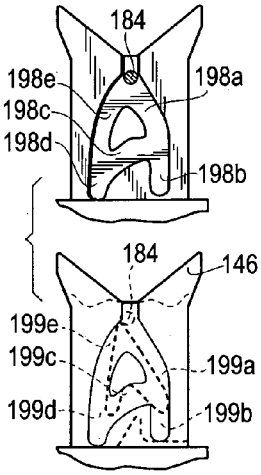
Figure 8G:
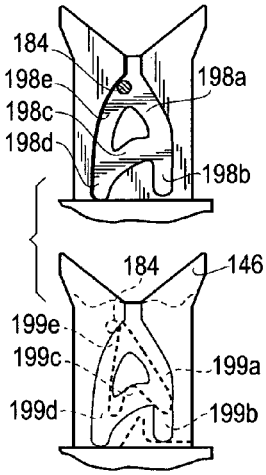
Figure 8H:
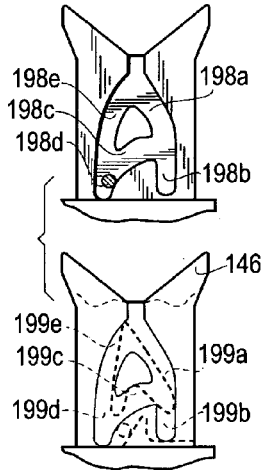
Figure 8I:
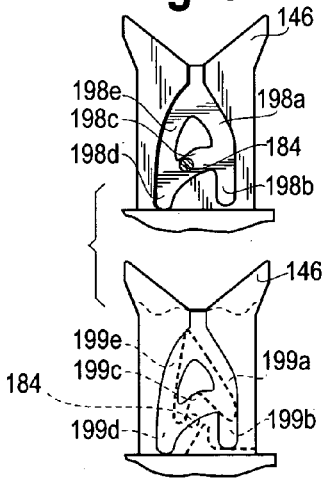
Figure 8J:
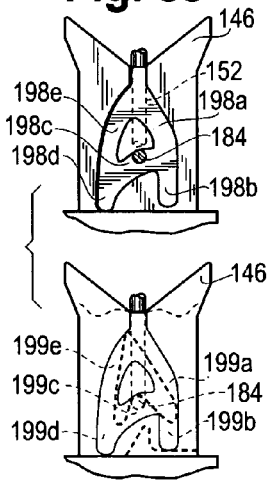
Figure 9:
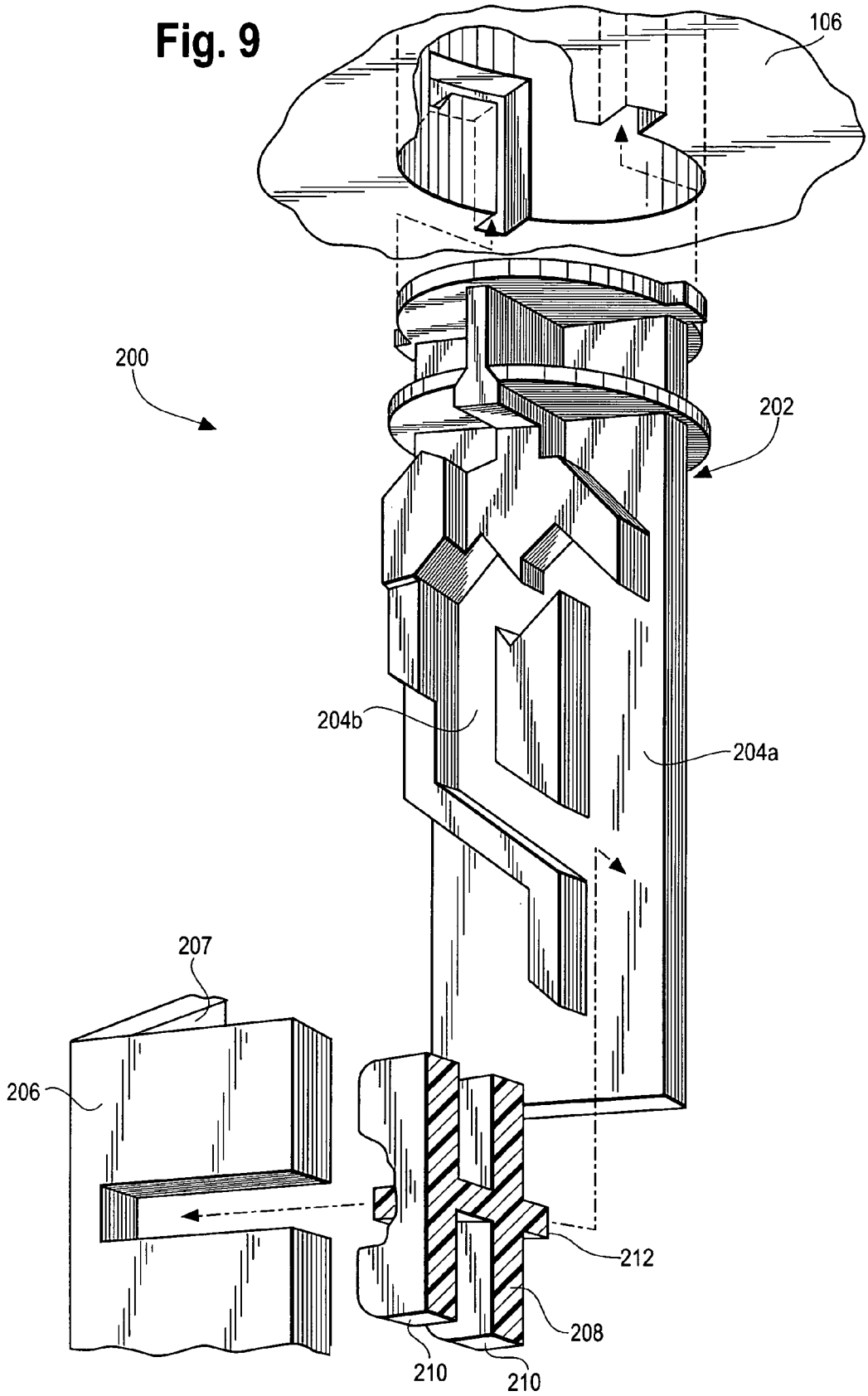
FIG. 9 is a partial perspective view of another embodiment of the latch for the container and the lid.
Figure 10:
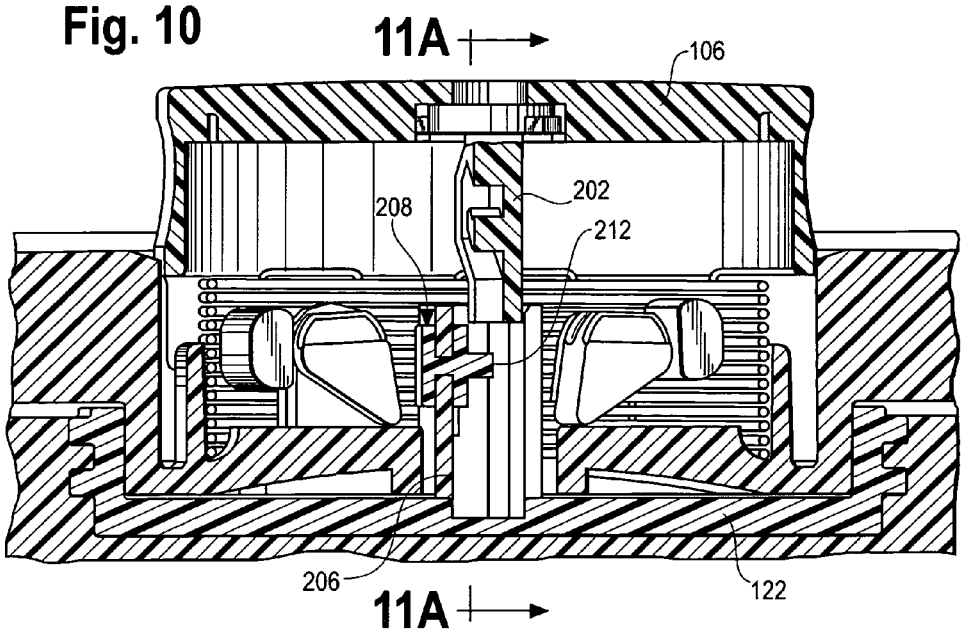
FIG. 10 is a cross-section view of the lid including the latch of FIG. 9.
Figure 11A:
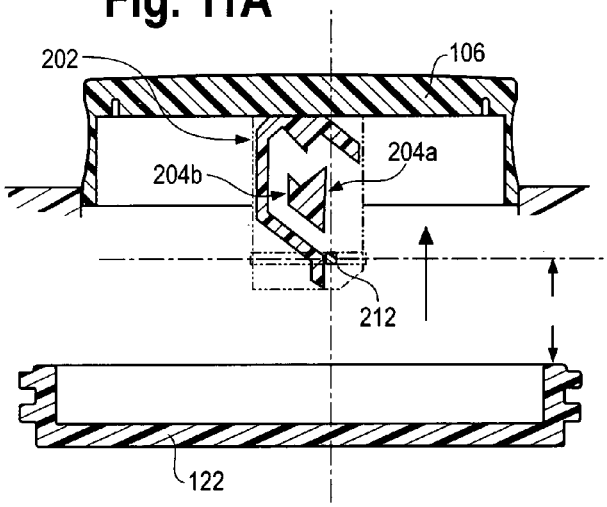
FIGS. 11A, 11B, 11C, 11D, 11E, 11F, 11G, 11H and 11I are partial cross-section views of the container and the lid of the embodiment of FIG. 9 illustrating an example of the movement of the pin along the cam surface defined by the latch.
Figure 11B:
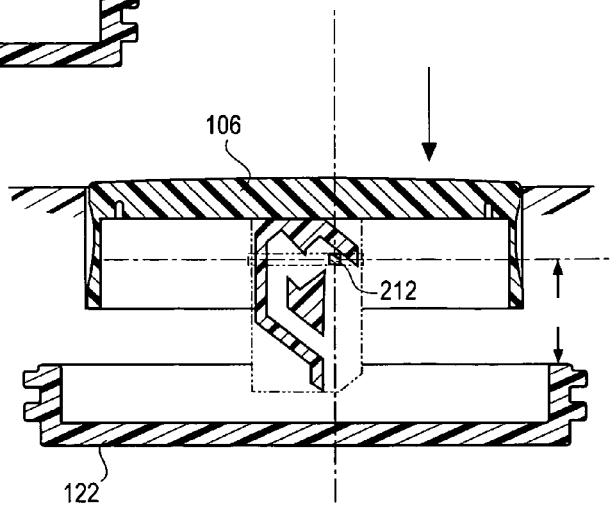
Figure 11C:
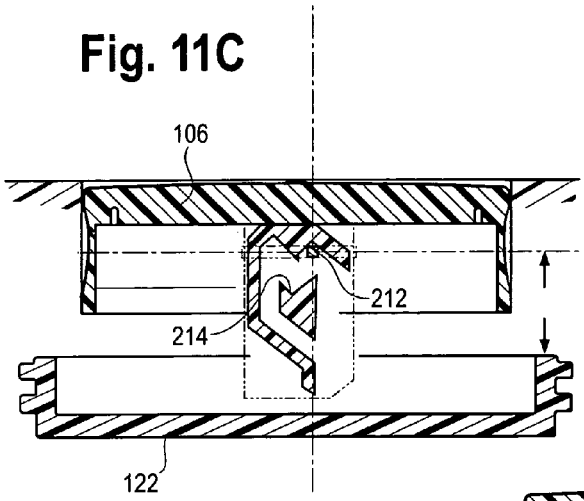
Figure 11D:
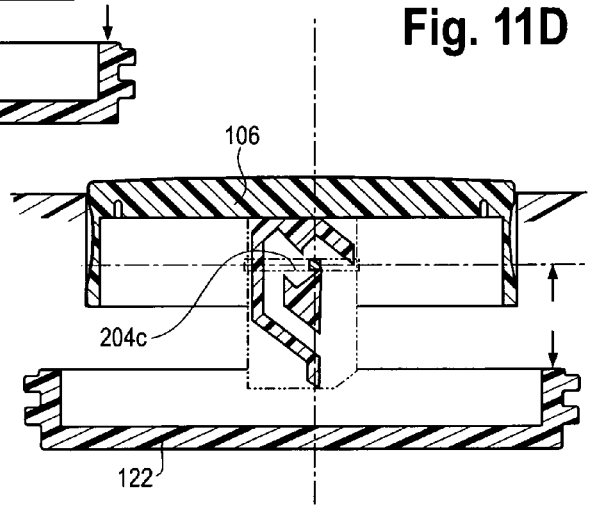
Figure 11E:
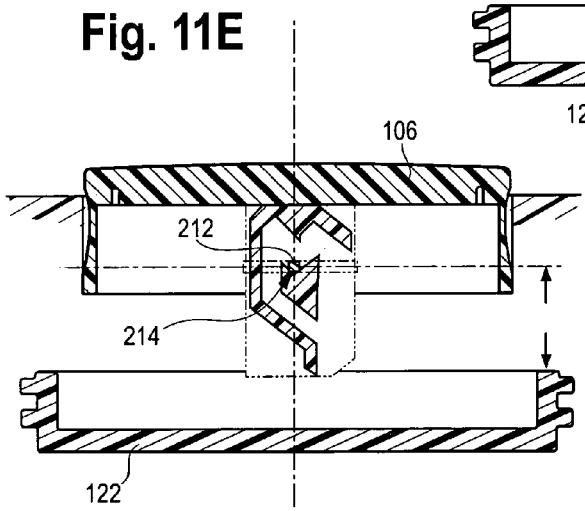
Figure 11F:
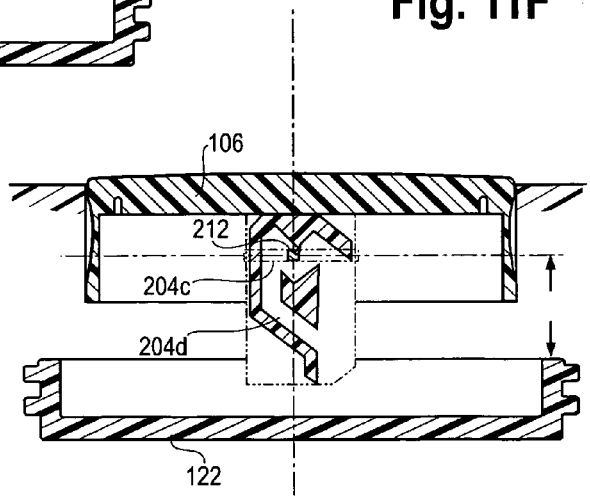
Figure 11G:
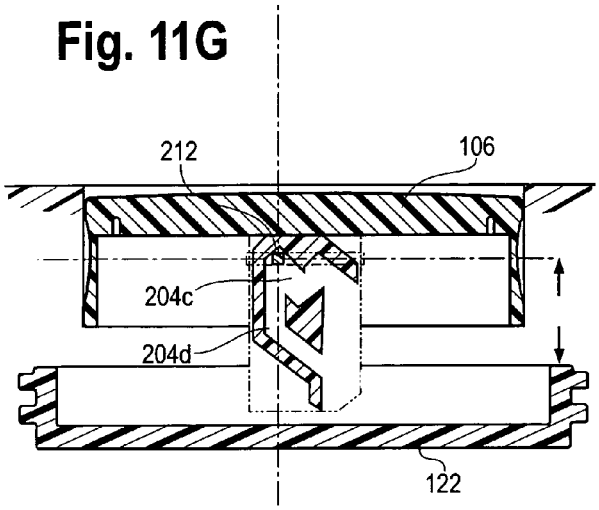
Figure 11H:
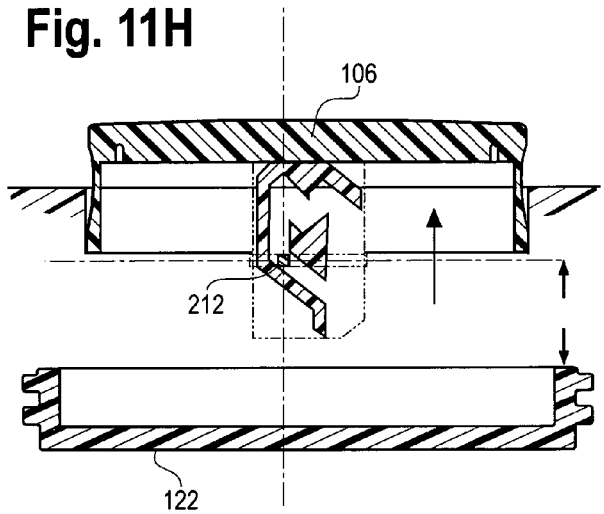
Figure 11I:
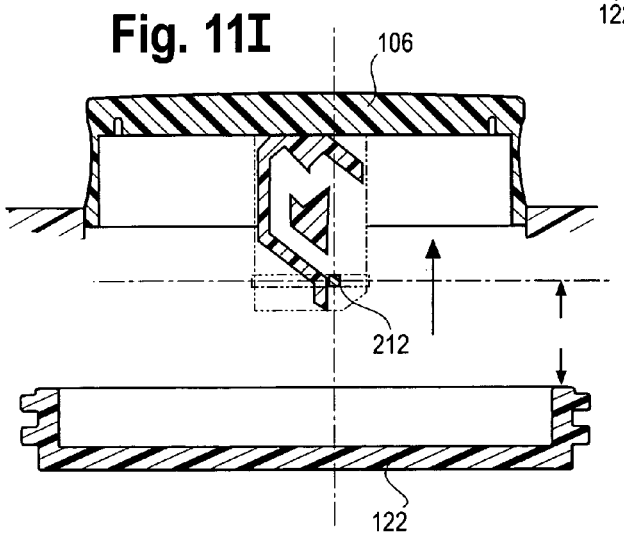

Referring now to FIGS. 8A to 8J, an example of how the U-shaped pin 152 engages and moves through latch 146 is illustrated. Specifically, FIGS. 8A to 8J illustrate the movement of the U-shaped pin 152 and in particular, how opposing prongs 184 move along the cam surfaces on the opposing sides of the latch. In FIG. 8A, the U-shaped pin and more specifically, the prongs 184 are respectively engaged with recesses 198*c* and 199*c* to hold or secure the U-shaped pin and thereby the lid in a locked position. As shown in FIGS. 8B, 8C and 8D, when a user wants to release the seal on the container, the user presses down on the button 106 to cause the U-shaped pin 152 to move downwardly along cam surface areas 198*b* and 199*b*, respectively. When the user releases pressure on the button and allows the button to pop-up, the U-shaped pin, and in particular the prongs 184, move along cam surfaces 198*a* and 199*a*, respectively. The pin 152 exits the opening defined by the latch as shown in FIG. 8F. The lid and seal are now unsecured and the lid may be removed from the container. To re-secure or seal the lid to the container, the user presses down on button 106 to cause pin 152 to move downwardly along cam surfaces 198*e* and 199*e*, respectively. The U-shaped pin 152 moves downwardly until engaging cam surface areas 198*d* and 199*d*, respectively, as shown in FIGS. 8F, 8G and 8H. As the user releases the button, the U-shaped pin 152 moves upwardly and to the right to engage recesses 198*c* and 199*c*, respectively. The pin has now returned to its initial position secured in recesses 198*c* and 199*c*, as shown in FIG. 8H. The lid is now secured to the container providing a seal between the lid and container.

Referring now to FIGS. 9, 10, 11A to 11I, an alternative embodiment of the latch mechanism or latch 200 is illustrated where the latch mechanism 200 enables the cover of the container to be sealed using a push-push operation. In this embodiment, the latch mechanism 200 includes a guide 202 connected to the bottom surface of the button 106. The guide 202 defines a plurality of cam surfaces 204*a* and 204*b*. Specifically, the cam surface 204*a* is a generally straight surface. The cam surfaces 204*a* and 204*b* together form a generally heart-shaped configuration as shown in FIGS. 10A-10I.

In the illustrated embodiment, the latch 200 includes a housing 206 connected to the cam plate 122. The housing 206 includes a wall structure 207 having one or more walls. The wall structure 207 defines a receptacle having an upper or top opening. The upper opening of the wall structure is sized to receive the guide 202. A slider 208 is movably connected to the housing. The slider 208 slides within a groove defined by the housing 206. In the illustrated embodiment, the slider 208 generally moves or slides laterally with respect to the housing. It should be appreciated that the slider may slide in any suitable direction or directions. In this embodiment, the slider includes flange members 210 which secure or hold the slider 208 on the housing 206. The slider 208 also includes a guide post 212 which extends into the receptacle defined by the housing 206. The guide post 212 extends a designated distance into the receptacle defined by the housing to engage the cam surfaces 204*a* and 204*b*.

In one example, the button 106 is initially in the up position as shown in FIG. 10A. It should be appreciated that the button 106 may initially be in the up or down position. Upon a first actuation of the button (i.e., a user pressing downwardly on the button), the button 106 moves downwardly causing the guide 202 to move downwardly into the upper opening defined by the housing 206. The guide post 212 of slider 208 engages the first cam surface 204*a* of the guide. This is a generally vertical or straight cam surface where the guide post 212 slides along the cam surface 204*a* until engages recess 214 defined by the guide 202 as shown in FIGS. 10B and 10C. The button is then released which causes the button to move upwardly. The upward movement of the button causes the guide post to move downwardly along cam surface 204*c* (shown in FIG. 10D) until stopping in recess 214. The guide post is now in a locked position in recess 214 which temporarily locks the button in the down position or the position in which the top of the button is substantially flush with the top surface of the lid 102 as shown in FIG. 10E.

Upon a second actuation of the button (i.e., the button is moved downward), the guide post 210 moves upwardly out of recess 214 and moves along cam surface 204*d* as shown in FIG. 10F. The angles of the cam surfaces 204*c* and 204*d* guide or direct the guide post 212 downwardly along one side of the guide 202 as shown in FIGS. 10G, 10H and 10I. While the guide post is moving along the cam surfaces, the slider 208 is moving laterally within the groove defined by the housing 206. When the guide post 212 exits the guide 202, the guide 202 continues moving upwardly until the button is in the up position. The lid 102 (as shown in FIGS. 1A and 1B) can now be removed from the container housing by the user.

In the embodiments described above, the components of the container are preferably made of a polymer or plastic which can be washed and stored. It should be appreciated however that the lid and the other components of the container may be made of any suitable material or materials. It should also be appreciated that the components of the container may be connected or manufactured in any suitable order other than that described above.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A storage container comprising:

a housing including an open-top wall structure defining a receptacle for receiving material to be stored;

a cover disposable on said housing in a closed position relative to said receptacle;

a push-push type button movably carried by said cover which is actuated by a pushing movement by a user;

a seal carried by said cover and shiftable between a compressed condition for sealingly engaging said wall structure when said cover is disposed in the closed position, and an uncompressed condition for disengaging from said wall structure; and a toggle mechanism coupled to said button and to said seal for effecting movement of said seal to its compressed and uncompressed conditions respectively in response to alternate actuations of said button.

2. The container of claim 1, wherein said toggle mechanism includes a latch having two sides, said sides respectively defining heart-shaped cam surfaces, each of said cam surfaces including a first cam surface portion and a second cam surface portion.

3. The container of claim 2, wherein said heart-shaped cam surfaces are symmetrical.

4. The container of claim 2, wherein said toggle mechanism includes a pin pivotably connected to said button and engageable with said latch, said first cam surface portion adapted to guide said pin to a locked position in response to a first actuation of said button, and said second cam surface portion adapted to guide said pin to an unlocked position in response to a second actuation of said button.

5. The container of claim 1, wherein said toggle mechanism includes a latch, an open-top housing and a slider movably connected to said housing, said latch defining a first cam surface and a second cam surface, said toggle mechanism operable to movably engage said latch with said housing causing said first cam surface to guide said slider to a locked position upon a first actuation of said button, and causing said second cam surface to guide said slider to an unlocked position upon a second actuation of said button.

6. The container of claim 1, wherein said cover includes an upper member, a bottom member and a cam plate connected to said bottom member, said cam plate movably connected to said upper member.

7. The container of claim 1, wherein said button is movable between an up position and a down position.

8. The container of claim 7, wherein said toggle mechanism includes a bias structure for biasing the button to the up position.

9. The container of claim 8, wherein said bias structure includes a pair of arms positioned adjacent to said button, said arms operable to pivot and move said button to the up position.

10. The container of claim 8, wherein the bias structure includes a spring operable to bias said button to the up position.

11. The container of claim 1, wherein at least one of said housing and said cover are substantially transparent.

12. A food storage device comprising:

a container including an open-top wall structure defining a receptacle for receiving a material to be stored;

a cover disposable on said wall structure, said cover including a top member defining a cup having a bottom surface, said bottom surface defining a plurality of slots, a bottom member positioned adjacent to said top member, and a cam plate connected to said bottom member, said cam plate including at least two posts and a latch, said posts being extendable through said slots of said receptacle, said latch including two sides, said sides respectively defining heart-shaped cam surfaces;

a seal positioned between said upper member and said bottom member of said cover;

a button including a bottom surface, said button being slidably connected to said cover;

a pair of pivot arms positioned adjacent to said bottom surface of said button, each of said pivot arms being pivotably connected to one of said posts of said cam plate, said pivot arms connected to said posts after said posts are inserted through said slots of said bottom surface of said receptacle to connect said cam plate and said bottom member to said upper member; and a pin connected to said bottom surface of said button, said pin including two opposing spaced apart arms, said arms being respectively engageable with said heart-shaped cam surfaces of said latch, wherein when said button is actuated a first time, said pivot arms move downwardly and said cam surfaces guide said arms of said pin to a locked position causing said seal to expand outwardly and engage said wall structure, and wherein when said button is actuated a second time, said cam surfaces guide said arms to an un-locked position, wherein said seal dis-engages said container and said pivot arms move upwardly against said bottom surface of said button to correspondingly move said button upwardly to a popped-up position.

13. The food storage device of claim 12, wherein said latch defines a recess, and wherein said pin is engaged with said recess in the locked position.

14. The food storage device of claim 12, which includes a spring positioned adjacent to said top member, said spring biasing said button to the popped-up position.

15. The food storage device of claim 14, wherein said spring is a coil spring.

16. The container of claim 12, wherein at least one of said container and said cover are substantially transparent.

17. A storage container comprising:

a housing including an open-top wall structure defining a receptacle for receiving material to be stored;

a cover disposable on said housing in a closed position relative to said receptacle;

a push-push type button movably carried by said cover which is actuated by a pushing movement by a user;

a seal carried by said cover and shiftable between a compressed condition for sealingly engaging said wall structure when said cover is disposed in the closed position, and an uncompressed condition for disengaging from said wall structure; and a toggle mechanism comprising at least one pivot arm, the at least one pivot arm being operably coupled to said push-push button and said seal, said toggle mechanism actuates said at least one pivot arm and moves said seal to its compressed and uncompressed conditions respectively in response to alternate actuations of said push-push button.

* * * * *